US006953157B2

(12) United States Patent
Boehland et al.

(10) Patent No.: US 6,953,157 B2
(45) Date of Patent: Oct. 11, 2005

(54) FUEL INJECTION DEVICE FOR AN INTERNAL COMBUSTION ENGINE

(75) Inventors: Peter Boehland, Marbach (DE); Michael Kurrle, Wendlingen (DE); Joerg-Peter Fischer, Deizisau (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 10/470,350

(22) PCT Filed: Nov. 12, 2002

(86) PCT No.: PCT/DE02/04139

§ 371 (c)(1),
(2), (4) Date: Jul. 28, 2003

(87) PCT Pub. No.: WO03/054375

PCT Pub. Date: Jul. 3, 2003

(65) Prior Publication Data

US 2004/0065751 A1 Apr. 8, 2004

(30) Foreign Application Priority Data

Dec. 7, 2001 (DE) ..... 101 60 264

(51) Int. Cl.[7] ..... F02M 47/02; F02M 41/16; B05B 9/00

(52) U.S. Cl. ..... 239/88; 90/91; 90/96; 90/124

(58) Field of Search ..... 239/88–92, 124, 239/96, 533.2, 533.3, 533.12; 251/122, 333; 123/467, 446, 447

(56) References Cited

U.S. PATENT DOCUMENTS 5,975,428 A * 11/1999 Potschin et al. ..... 239/88
6,290,204 B1 * 9/2001 Kienzler et al. ..... 251/57

* cited by examiner

*Primary Examiner*—David A. Scherbel
*Assistant Examiner*—Seth Barney
(74) *Attorney, Agent, or Firm*—Ronald E. Greigg

(57) ABSTRACT

The fuel injection system having one high-pressure fuel pump and one fuel injection valve for each engine cylinder in which the pump piston defines a work chamber, which communicates with a pressure chamber of the fuel injection valve. A control valve controls connection of the pump work chamber with a relief chamber and having a second control valve controls a connection of a control pressure chamber, which communicates with the pump work chamber defined by a control piston with a relief chamber is controlled, and in which connection a throttle restriction is provided. A flow cross section of the connection of the control pressure chamber with the relief chamber is controlled as a function of the stroke of the control piston, such that with an increasing opening stroke of the injection valve member, a smaller flow cross section is uncovered by the control piston and at the maximum opening stroke of the injection valve member, the uncovered flow cross section is smaller than the flow cross section of the second throttle restriction.

15 Claims, 2 Drawing Sheets

20
19
10
18
16
14
22
82
78
76
24
54
70
72
73
75
74
66
70
II
52
60
62
64
50
59
46
44
61
48
49
29
70
30
40
28
26
42
38
12
36
34
32
24
80
82

FUEL INJECTION DEVICE FOR AN INTERNAL COMBUSTION ENGINE

CROSS-REFERENCE TO RELATED APPLICATIONS

This application is a 35 USC 371 application of PCT/DE 02/04139 filed on Nov. 12, 2002.

BACKGROUND OF THE INVENTION

1. Field of the Invention

The invention is directed to an improved fuel injection system for an internal combustion engine of the type having a high pressure fuel pump and a fuel injection valve for each engine cylinder.

2. Description of the Prior Art

One fuel injection systems known from European Patent Disclosure EP 0 987 431 A2, has one high-pressure fuel pump and one fuel injection valve communicating with it for each cylinder of the engine. The high-pressure fuel pump has a pump piston, which is driven by the engine in a reciprocating motion and defines a pump work chamber. The fuel injection valve has a pressure chamber communicating with the pump work chamber and also has an injection valve member, by which at least one injection opening is controlled and which is movable, acted upon by the pressure prevailing in the pressure chamber, in the opening direction counter to a closing force to uncover the at least one injection opening. A first electrically actuated control valve is provided, by which a connection of the pump work chamber with a relief chamber is controlled. A second electrically actuated control valve is also provided, by which a connection of a control pressure chamber with a relief chamber is controlled. The control pressure chamber communicates with the pump work chamber via a throttle restriction. The control pressure chamber is defined by a control piston, which is braced on the injection valve member in its closing direction and which is urged in the closing direction of the injection valve member by the pressure prevailing in the control pressure chamber. For a fuel injection, the first control valve is closed and the second control valve is opened, so that high pressure cannot build up in the control pressure chamber, and the fuel injection valve can open. However, when the second control valve is opened, fuel flows out of the pump work chamber via the control pressure chamber, so that of the fuel quantity pumped by the pump piston, the fuel quantity available for injection is reduced, as is the pressure available for the injection. As a consequence, the efficiency of the fuel injection system is not optimal, and the course of the fuel injection cannot be adjusted in the desired way.

SUMMARY OF THE INVENTION

The fuel injection system of the invention has the advantage over the prior art that when the second control valve has been opened for fuel injection and the fuel injection valve is thus open, only a small flow cross section from the control pressure chamber to the relief chamber is uncovered, and thus only a slight fuel quantity flows out; as a result, the pressure available for the injection and the efficiency of the fuel injection system are increased. At the onset of termination of fuel injection, fast opening and closure of the fuel injection valve are moreover attained, which is made possible by a fast pressure reduction and pressure buildup in the control pressure chamber upon opening and closure, respectively, of the second control valve, as a consequence of the variable flow cross section controlled by the control piston.

Advantageous features and refinements of the fuel injection system of the invention are disclosed. One embodiment makes it possible in a simple way to control the flow cross section.

BRIEF DESCRIPTION OF THE DRAWINGS

One exemplary embodiment of the invention is described herein below, with reference to the drawings, in which.

DESCRIPTION OF THE PREFERRED EMBODIMENT

Figure 1:
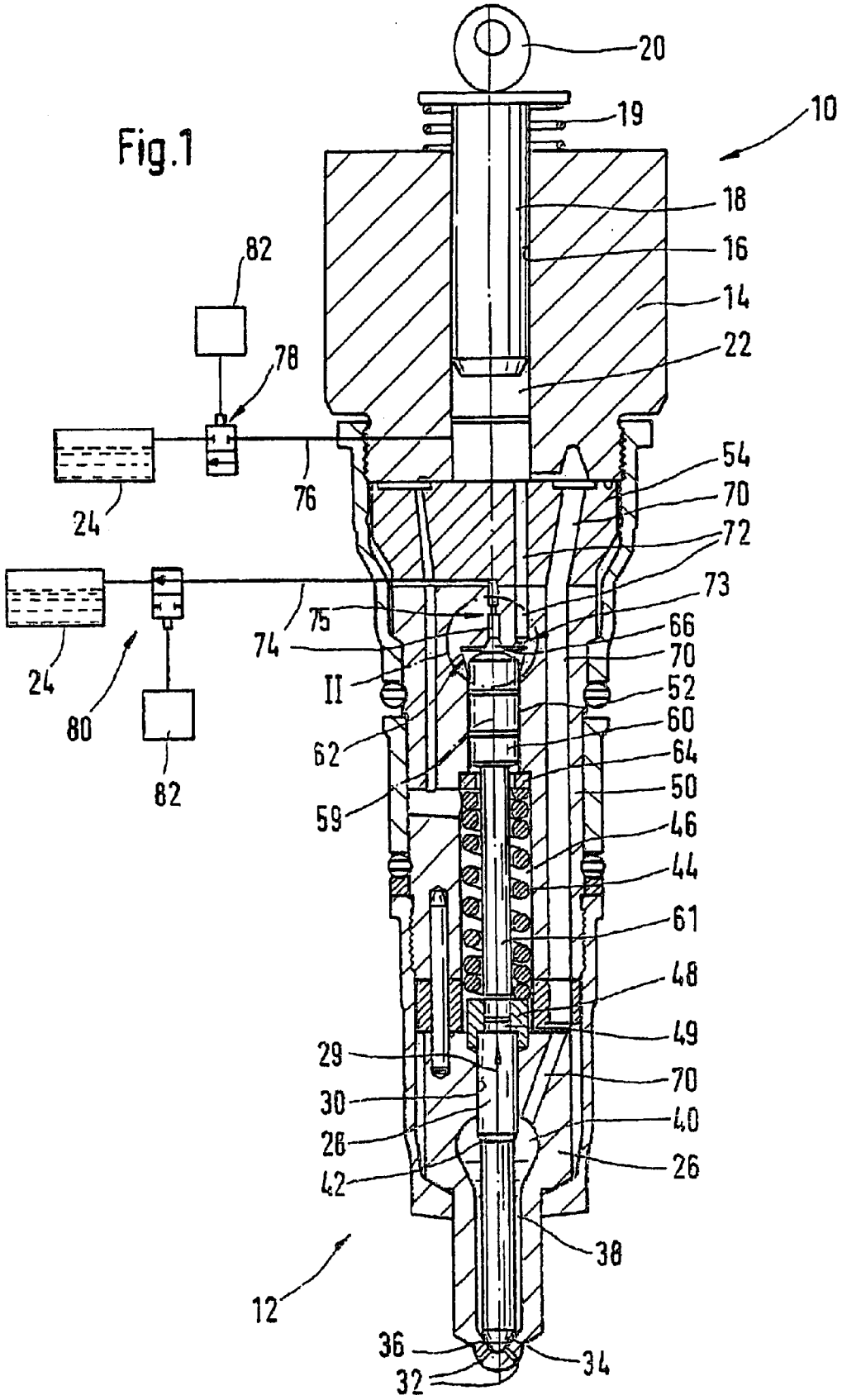
FIG. 1 shows a fuel injection system for an internal combustion engine in a longitudinal section, in a simplified illustration.
Figure 2:
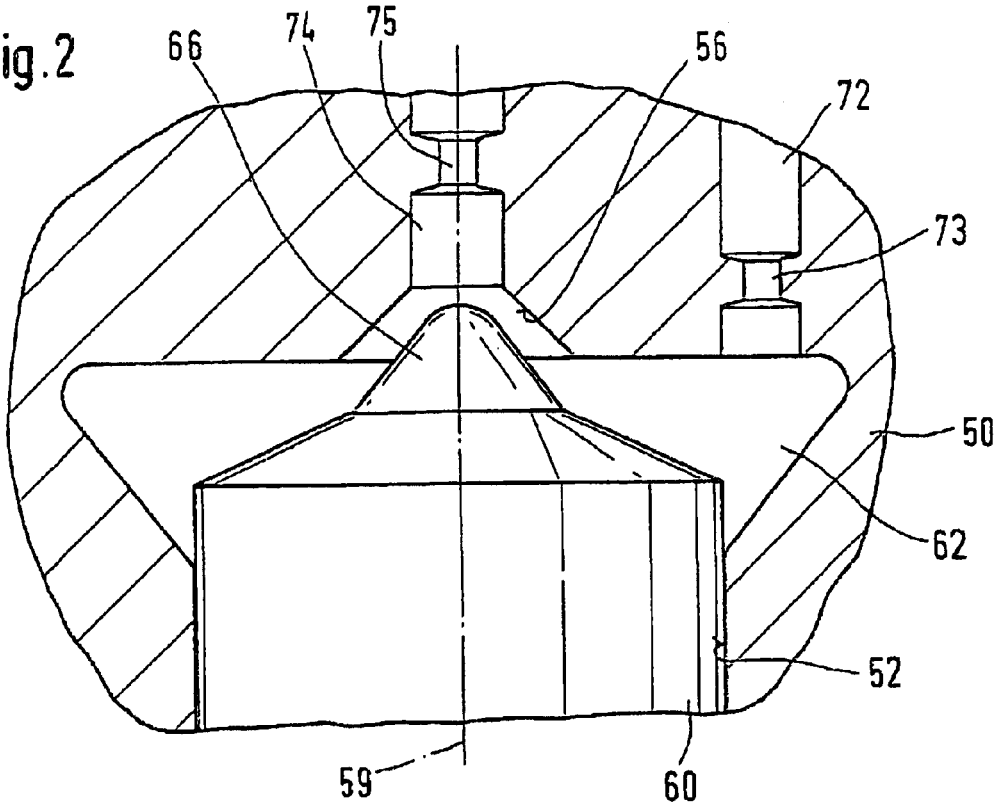
FIG. 2 shows an enlarged detail, marked II in FIG. 1, with a control piston in a first stroke position.
Figure 3:
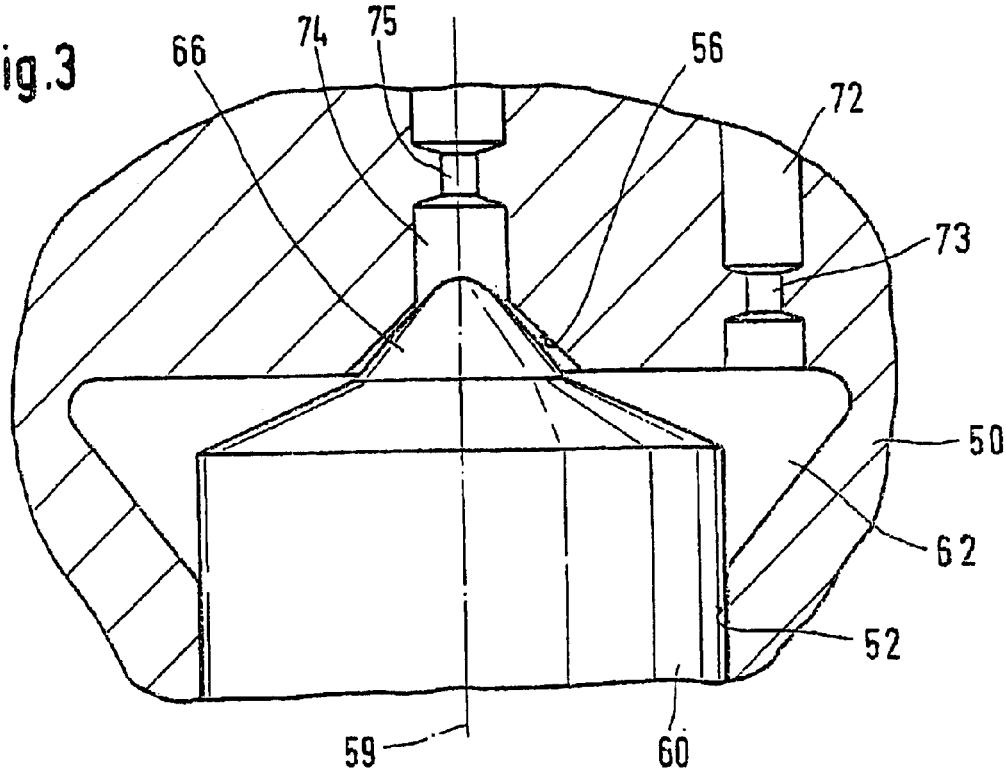
FIG. 3 shows the detail II with the control piston in a second stroke position.

In FIGS. 1–3, a fuel injection system for an internal combustion engine of a motor vehicle is shown. The engine is preferably a self-igniting internal combustion engine. The fuel injection system is preferably embodied as a so-called unit fuel injector, and for each cylinder of the engine, it has one high-pressure fuel pump 10 and one fuel injection valve 12, communicating with it, and these form a common structural unit. Alternatively, the fuel injection system can be embodied as a so-called pump-line-nozzle system, in which the high-pressure fuel pump and the fuel injection valve of each cylinder are disposed separately from one another and communicate with one another via a line. The high-pressure fuel pump 10 has a pump body 14 with a cylinder bore 16, in which a pump piston 18 is guided tightly; the pump piston is driven in a reciprocating motion at least indirectly by a cam 20 of a camshaft of the engine, counter to the force of a restoring spring 19. In the cylinder bore 16, the pump piston 18 defines a pump work chamber 22, in which fuel is compressed at high pressure in the pumping stroke of the pump piston 18. Fuel is delivered to the pump work chamber 22 from a fuel tank 24 of the motor vehicle.

The fuel injection valve 12 has a valve body 26, which communicates with the pump body 14 and can be embodied in multiple parts, and in which an injection valve member 28 is guided longitudinally displaceably in a bore 30. The valve body 26, in its end region toward the combustion chamber of the cylinder of the engine, has at least one and preferably a plurality of injection openings 32. The injection valve member 28, in its end region toward the combustion chamber, has a sealing face 34, which is for instance approximately conical, and which cooperates with a valve seat 36, embodied in the valve body 26 in its end region toward the combustion chamber; the injection openings 32 lead away from this valve seat or downstream of it. In the valve body 26, between the injection valve member 28 and the bore 30, toward the valve seat 36, there is an annular chamber 38, which in its end region remote from the valve seat 36 changes over, by means of a radial enlargement of the bore 30, into a pressure chamber 40 surrounding the injection valve member 28. At the level of the pressure chamber 40, as a result of a cross-sectional reduction, the injection valve member 28 has a pressure shoulder 42.

The end of the injection valve member 28 remote from the combustion chamber is engaged, as shown in FIG. 1, for instance via a sleeve 48, by a prestressed closing spring 44, by which the injection valve member 28 is urged in its closing direction toward the valve seat 36. The closing spring 44 is disposed in a spring chamber 46 of a housing part 50 that adjoins the valve body 26. The spring chamber 46 is formed by a bore in the housing part 50 that is coaxial to the bore 30 in the valve body 26.

As shown in FIG. 1, on the end of the spring chamber remote from the bore 30, the bore that forms the spring chamber 46 is adjoined in the housing part 50 by a further coaxial bore 52, which is for instance smaller in diameter than the diameter of the spring chamber 46, and in which a control piston 60 braced on the injection valve member 28 is tightly guided. In the bore 52, in its end region remote from the spring chamber 46, a control pressure chamber 62 is defined by the control piston 60. The control piston 60 is braced on the injection valve member 28, via a piston rod 61 whose diameter is smaller than that of the control piston. The end of the piston rod 61 oriented toward the injection valve member 28 protrudes from one end into the sleeve 48 and can additionally be guided therein. From the other end of the sleeve 48, the end of the injection valve member 28, which is larger in diameter than the piston rod 61, protrudes into the sleeve. A compensation disk 49 can be disposed inside the sleeve 48, between the piston rod 61 and the injection valve member 28, to make it possible, by using a disk 49 of the appropriate thickness, to adjust the length of the unit comprising the injection valve member 28 and the control piston 60 exactly. The closing spring 44 surrounds the piston rod 61 and is braced on one end on the sleeve 48, and hence indirectly on the injection valve member 28, and on the other end on a spring plate 64 that rests on an annular shoulder formed at the transition from the spring chamber bore 46 to the smaller-diameter control pressure chamber bore 62.

A shim 54 is disposed between the housing part 50 and the pump body 14. From the pump work chamber 22, a conduit 70 leads through the pump body 14, the shim 54, the housing part 50 and the valve body 26 to the pressure chamber 40 of the fuel injection valve 12. A conduit 72 also leads from the pump work chamber 22 through the shim 54 and the housing part 50 to the control pressure chamber 62. A first throttle restriction in the form of a throttle bore 73 is disposed in the conduit 72 in the housing part 50. A conduit 74, which forms a communication with a relief chamber, as which the fuel tank 24 or some other region where a low pressure prevails can serve at least indirectly, also discharges into the control pressure chamber 62. From the pump work chamber 22 or from the conduit 70, a connection 76 leads to a relief chamber 24, which is controlled by a first electrically actuated control valve 78. The control valve 78 can be embodied as a 2/2-way valve, as shown in FIG. 1. The connection 74 of the control pressure chamber 62 with the relief chamber 24 is controlled by a second electrically actuated control valve 80, which can be embodied as a 2/2-way valve. The control valves 78, 80 can have an electromagnetic actuator or a piezoelectric actuator and are triggered by an electronic control unit 82.

As shown in FIGS. 1–3, the bore 52 has a radial enlargement in its end region, for forming the control pressure chamber 62. The conduit 72 discharges into the control pressure chamber 62 in a peripheral region, offset from the longitudinal axis 59 of the control piston 60. The conduit 74 preferably discharges into the control pressure chamber 62 coaxially with the longitudinal axis 59 of the control piston 60, and a second throttle restriction in the form of a throttle bore 75 is disposed in the conduit 74. The throttle bore 75 is disposed in the housing part 50, spaced apart from the orifice where the conduit 74 discharges into the control pressure chamber 62. The orifice 56 where the conduit 74 discharges into the control pressure chamber 62 is embodied such that the cross section of the conduit 74 increases toward the control pressure chamber 62; the orifice 56 can for instance be embodied as conically widened. The control piston 60, on its end remote from the injection valve member 28, has a tang 66, disposed coaxially to the longitudinal axis 59 of the injection valve member and protruding toward the conduit 74; the tang is adapted in cross section to the orifice 56, for instance being smaller than the region of the control piston 60 that is guided in the bore 52. The tang 66 is embodied such that it tapers toward the conduit 74; for instance, the tang 66 can be embodied as tapering conically.

The control piston 60, with its tang 66, cooperates with the orifice 56 of the conduit 74 for controlling a flow cross section out of the control pressure chamber 62 into the conduit 74 and through this conduit, when the second control valve 80 is open, into the relief chamber 24. When the control piston 60 is in a stroke position as shown in FIG. 2, in which it is disposed with its tang 66 at a great spacing from the orifice 56 of the conduit 74, a large flow cross section from the control pressure chamber 62 into the conduit 74 is uncovered between the tang 66 and the orifice 56. The least flow cross section for the outflow of fuel from the control pressure chamber 62 is represented by the throttle bore 75 in the housing part 50, which bore has a defined, fixed flow cross section. The control piston 60 is located in this stroke position when the fuel injection valve 12 is closed and its injection valve member 28 is resting with its sealing face 34 on the valve seat 36. When the control piston 60, in a reciprocating motion, moves with its tang 66 toward the orifice 56 of the conduit 74, the uncovered flow cross section becomes smaller. When the control piston 60 as shown in FIG. 3 is disposed with its tang 66 at only a slight spacing from the orifice 56 of the conduit 74, then only a flow cross section that is smaller than the flow cross section of the throttle restriction 75 is now uncovered, so that the flow cross section between the tang 66 and the orifice 56 represents the actual throttle restriction for fuel flowing out of the control pressure chamber 62. The control piston 60 is located in this stroke position when the fuel injection valve 12 is open and its injection valve member 28 has lifted with its sealing face 34 from the valve seat 36.

The function of the fuel Injection system will now be explained. In the intake stroke of the pump piston 18, fuel from the fuel tank 24 is delivered to the pump piston. In the pumping stroke of the pump piston 18, the fuel Injection begins, with a preinjection In which the first control valve 78 is closed by the control unit 82, so that the pump work chamber 22 is disconnected from the relief chamber 24. The second control valve 80 can initially be closed, so that the control pressure chamber 62 is disconnected from the relief chamber 24, and the same pressure prevails in the control pressure chamber as in the pump work chamber 22, so that no fuel injection can occur. At the onset of the fuel injection, the second control valve 80 is then opened by the control unit 82, so that the control pressure chamber 82 is in communication with the relief chamber 24. In this case high pressure cannot build up in the control pressure chamber 62, because the control pressure chamber is relieved toward the relief chamber 24. When the pressure in the pump work chamber 22 and thus in the pressure chamber 40 of the fuel injection valve 12 is so great that the pressure force exerted by the fuel Injection valve on the injection valve member 28 via the pressure shoulder 42 is greater than the total force of the closing spring 44 and of the pressure force acting on the control piston 60 as a result of the residual pressure operative in the control pressure chamber 62, then the injection valve member 28 moves In the opening direction 29 and uncovers the at least one injection opening 32. The control piston 60 thereupon assumes its stroke position shown in FIG. 2, in which now only a small flow cross section is uncovered between its tang 66 and the orifice 56 of the conduit 74, thus forming a throttle restriction of lesser flow cross section than that of the throttle bore 75. Thus of the fuel pumped by the pump piston 18, only a slight partial quantity can flow out via the throttle restriction between the tang 66 and the orifice 58 through the conduit 74 and the opened second control valve 80 into the relief chamber 24.

To terminate the preinjection, the second control valve 80 is closed by the control unit, so that the control pressure chamber 62 is disconnected from the relief chamber 24. The first control valve 78 remains in its closed position. In the control pressure chamber 62, high pressure thereupon builds up as in the pump work chamber 22, so that a high pressure force acts in the closing direction on the control piston 60, and the injection valve member 28 is moved in its closing direction. The control piston 60 then assumes its stroke position shown in FIG. 3.

For an ensuing main injection, the second control valve 80 is opened by the control unit 82. The fuel injection valve 12 then opens as a consequence of the reduced pressure force on the control piston 60, and the injection valve member 28 moves into its opening position over its maximum opening stroke. In the opening motion of the injection valve member 28, the flow cross section of the throttle bore 75 is initially operative as a least flow cross section, since a large flow cross section is uncovered between the tang 66 of the control piston 60 and the orifice 56 of the conduit 74. As a result, a fast opening of the fuel injection valve 12 is made possible, since the throttle bore 75 can be embodied with a relatively large flow cross section. Once the fuel injection valve 12 is completely open, the tang 66 of the control piston 60 is located at a slight spacing from the orifice 56 of the conduit 74, and so now only a slight flow cross section is uncovered, which is smaller than the flow cross section of the throttle bore 75. The control piston 60 remains in a state of equilibrium, with its tang 66 spaced apart from the orifice 56 of the conduit 74, since if the tang 66 were to come into contact with the orifice 56, the control pressure chamber 62 would be completely disconnected from the relief chamber 24, which in turn would mean that the injection valve member 28 would move in the closing direction, and the control piston 60 would move with its tang 66 away from the orifice 56. That in turn would uncover a larger flow cross section again, so that the pressure in the control pressure chamber 62 would drop again, and the injection valve member 28 would move in the opening direction 29, so that the spacing between the tang 66 and the orifice 56, and thus the flow cross section, would become smaller again. The tang 66 of the control piston 60 and the orifice 56 of the conduit 74 form a hydraulic stop for the control piston 60 and the injection valve member 28.

To terminate the main injection, the second control valve 80 is put in its closed switching position by the control unit 82, so that the control pressure chamber 62 is disconnected from the relief chamber 24 and a high pressure builds up in the control pressure chamber, and by way of the force acting on the control piston 60, the fuel injection valve 12 is closed. In the closing motion of the injection valve member 28, a large flow cross section is uncovered by the control piston 60 between its tang 66 and the orifice 56, so that the pressure in the control pressure chamber 62 increases quickly and exerts a high pressure force on the control piston 60, so that the fuel injection valve 12 closes quickly. For a postinjection of fuel, the second control valve 80 is opened once again by the control unit 82, so that as a consequence of the reduced pressure in the control pressure chamber 62, the fuel injection valve 12 opens. For terminating the postinjection, the second control valve 80 is closed and/or the first control valve 78 is opened.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, having one high-pressure fuel pump (10) and one fuel injection valve (12), communicating with it, for each cylinder of the engine, wherein the high-pressure fuel pump (10) has a pump piston (18), which is driven by the engine in a reciprocating motion and defines a pump work chamber (22) to which fuel is delivered from a fuel tank (24), wherein the fuel injection valve (12) has a pressure chamber (40), communicating with the pump work chamber (22), and an injection valve member (28), by which at least one injection opening (32) is controlled and which is urged by the pressure prevailing in the pressure chamber (40) counter to a closing force in the opening direction (29) to open the at least one injection opening (32), having a first control valve (78), by which a connection (76) of the pump work chamber (22) with a relief chamber (24) is controlled, and having a second control valve (80), by which a connection (74) of a control pressure chamber (62) of the fuel injection valve with a relief chamber (24) is controlled, wherein the control pressure chamber (62) at least indirectly has a connection (62) with the pump work chamber (22), in which connection a first throttle restriction (73) is provided, and the control pressure chamber (62) is defined by a control piston (60), which acts on the injection valve member (28) in a closing direction, the improvement comprising a second throttle restriction (75) with a fixed flow cross section in the connection (74) of the control pressure chamber (62) with the relief chamber (24), wherein the control piston (60), with its side (66) remote from the injection valve member (28), controls a flow cross section from the control pressure chamber (62) to the connection (74) with the relief chamber (24) as a function of the stroke of the control piston (60); wherein with an increasing opening stroke of the injection valve member (28) providing a smaller flow cross section uncovered by the control piston (60); and wherein at a maximum opening stroke of the injection valve member (28), the uncovered flow cross section is less than the flow cross section of the second throttle restriction (75).

2. The fuel injection system of claim 1, wherein the control piston (60), on its side remote from the injection valve member (28), comprises a tang (66), with which the control piston (80), when the injection valve member (28) is open, plunges into an orifice (56) of the connection (74) of the control pressure chamber (62) with the relief chamber (24); and wherein between the tang (66) and the orifice (56), the flow cross section is controlled by the control piston (60).

3. The fuel injection system of claim 2, wherein the tang (66) and the orifice (56) of the connection (74) are each embodied at least approximately conically.

4. The fuel Injection system of claim 1, wherein the control pressure chamber (62) is embodied in a bore (52) in a housing part (50) of the fuel injection system; and wherein the first throttle restriction (73) and the second throttle restriction (75) are embodied as throttle bores in this housing part (50).

5. The fuel injection system of claim 2, wherein the control pressure chamber (62) is embodied in a bore (52) in a housing part (50) of the fuel injection system; and wherein the first throttle restriction (73) and the second throttle restriction (75) are embodied as throttle bores in this housing part (50).

6. The fuel injection system of claim 3, wherein the control pressure chamber (62) is embodied in a bore (52) in a housing part (50) of the fuel injection system; and wherein the first throttle restriction (73) and the second throttle restriction (75) are embodied as throttle bores in this housing part (50).

7. The fuel injection system of claim 4, further comprising a further bore, forming a spring chamber (46) adjoining the bore (52) in the housing part (50) that forms the control pressure chamber (62), a closing spring in this further bore forming the spring chamber a closing spring (44), the closing spring serving to generate the closing force and acting at least indirectly on the injection valve member (28), the control pressure chamber (62) being separated from the spring chamber (46) by the control piston (60).

8. The fuel injection system of claim 5, further comprising a further bore, forming a spring chamber (46) adjoining the bore (52) in the housing part (50) that forms the control pressure chamber (62), a closing spring in this further bore forming the spring chamber a closing spring (44), the closing spring serving to generate the closing force and acting at least indirectly on the injection valve member (28), the control pressure chamber (62) being separated from the spring chamber (46) by the control piston (60).

9. The fuel injection system of claim 6, further comprising a further bore, forming a spring chamber (46) adjoining the bore (52) in the housing part (50) that forms the control pressure chamber (62), a closing spring in this further bore forming the spring chamber a closing spring (44), the closing spring serving to generate the closing force and acting at least indirectly on the injection valve member (28), the control pressure chamber (62) being separated from the spring chamber (46) by the control piston (60).

10. The fuel injection system of claim 4, wherein the high-pressure fuel pump (10) and the fuel injection valve (12) form a common structural unit; and wherein the housing part (50) is disposed between a pump body (14) of the high-pressure fuel pump (10) and a valve body (26) of the fuel Injection valve (12).

11. The fuel injection system of claim 5, wherein the high-pressure fuel pump (10) and the fuel injection valve (12) form a common structural unit; and wherein the housing part (50) is disposed between a pump body (14) of the high-pressure fuel pump (10) and a valve body (26) of the fuel injection valve (12).

12. The fuel Injection system of claim 6, wherein the high-pressure fuel pump (10) and the fuel injection valve (12) form a common structural unit; and wherein the housing part (50)is disposed between a pump body (14) of the high-pressure fuel pump (10) and a valve body (26) of the fuel injection valve (12).

13. The fuel injection system of claim 7, wherein the high-pressure fuel pump (10) and the fuel injection valve (12) form a common structural unit; and wherein the housing part (50)18 disposed between a pump body (14) of the high-pressure fuel pump (10) and a valve body (26) of the fuel injection valve (12).

14. The fuel injection system of claim 8, wherein the high-pressure fuel pump (10) and the fuel injection valve (12) form a common structural unit; and wherein the housing part (50)is disposed between a pump body (14) of the high-pressure fuel pump (10) and a valve body (26) of the fuel injection valve (12).

15. The fuel injection system of claim 9, wherein the high-pressure fuel pump (10) and the fuel injection valve (12) form a common structural unit; and wherein the housing part (50) is disposed between a pump body (14) of the high-pressure fuel pump (10) and a valve body (26) of the fuel injection valve (12).

* * * * *